United States Patent [19]

Martin

[11] Patent Number: 4,682,935

[45] Date of Patent: Jul. 28, 1987

[54] BOWED TURBINE BLADE

[75] Inventor: Jack R. Martin, Bedford, Mass.

[73] Assignee: General Electric Company, Lynn, Mass.

[21] Appl. No.: 560,718

[22] Filed: Dec. 12, 1983

[51] Int. Cl.[4] ..... F01D 5/12

[52] U.S. Cl. ..... 416/223 A; 416/242; 416/DIG. 2; 415/181

[58] Field of Search ..... 416/223 A, DIG. 2, 242; 415/181

[56] References Cited

U.S. PATENT DOCUMENTS

| | | | |
|---|---|---|---|
| 1,613,816 | 1/1927 | Biggs | 416/242 X |
| 2,660,401 | 11/1953 | Hull | 416/243 |
| 2,663,493 | 12/1953 | Keast | 416/223 A |
| 2,715,011 | 8/1955 | Schorner | 416/243 |
| 2,915,238 | 12/1959 | Szydlowski | 416/242 |
| 3,128,939 | 4/1964 | Szydlowski | 416/242 |
| 3,333,817 | 8/1967 | Rhomberg | 416/242 |
| 3,851,994 | 12/1974 | Seippel | 416/216 |
| 3,871,791 | 3/1975 | Guy et al. | 416/242 |
| 3,989,406 | 11/1976 | Bliss | 416/223 A |
| 4,012,172 | 3/1977 | Schwaar et al. | 416/223 A X |
| 4,047,841 | 9/1977 | Laurin | 416/131 X |
| 4,131,387 | 12/1978 | Kazin et al. | 416/223 A X |
| 4,284,388 | 8/1981 | Szewalski | 416/223 A |
| 4,460,315 | 7/1984 | Tseng | 416/216 |
| 4,470,755 | 9/1984 | Bessay | 415/181 X |

FOREIGN PATENT DOCUMENTS

| | | | |
|---|---|---|---|
| 2144600 | 3/1973 | Fed. Rep. of Germany | 416/223 A |
| 99211 | 6/1982 | Japan | 416/242 |
| 376647 | 7/1932 | United Kingdom | 416/242 |
| 2064667 | 6/1981 | United Kingdom | 416/DIG. 2 |
| 646095 | 2/1979 | U.S.S.R. | 416/DIG. 2 |

OTHER PUBLICATIONS

Aviation Wk. & Space Technology–May 2, 1983, Howmet advertisement.

F404 LP Turbine Aeromechanical Summary, Feb 12, 1976, V. M. Cardinale and R. A. McKay, four-page Extract.

*Primary Examiner*—Everette A. Powell, Jr.

*Attorney, Agent, or Firm*—Francis L. Conte; Derek P. Lawrence

[57] ABSTRACT

The invention comprises a blade for a gas turbine engine including an airfoil portion having a non-linear stacking axis which is effective for generating a compressive component of bending stress due to centrifugal force acting on the blade. The compressive component of bending stress is provided in a life-limiting section of the blade, which, for example, includes trailing and leading edges of the blade. Inasmuch as the stacking axis, which represents the locus of centers of gravity of transverse sections of an airfoil portion of the blade, is non-linear, an increased amount of a compressive component of bending stress can be generated at a life-limiting section between root and tip sections of the blade without substantially increasing bending stress at the root of the blade.

9 Claims, 4 Drawing Figures

BOWED TURBINE BLADE

The Government has rights in this invention pursuant to Contract No. N00019-76-C-0261 awarded by the Navy.

CROSS REFERENCE TO A RELATED APPLICATION

This application is related to application Ser. No. 560,656, now U.S. Pat. No. 4,585,395, issued Apr. 29, 1986, and assigned to the same assignee as the instant application.

BACKGROUND OF THE INVENTION

This invention relates generally to blades for a gas turbine engine and, more particularly, to an improved blade effective for reducing stresses due to centrifugal force to improve the useful life of the blade.

An axial flow gas turbine engine conventionally includes a plurality of rows of alternating stationary vanes and rotating blades. The rotating blades are typically found in fan, compressor, and turbine sections of the engine, and inasmuch as these blades rotate for performing work in the engine, they are subject to stress due to centrifugal forces.

The centrifugal stress in a blade is relatively substantial and includes a substantially uniform centrifugal tensile stress and centrifugal bending stress including a tensile component and a compressive component which are added to the uniform tensile stress.

In a turbine section of the gas turbine engine, turbine blades are also subject to relatively hot, pressurized combustion gases. These gases induce bending stresses due to the pressure of the combustion gases acting across the turbine blades, which stresses are relatively small when compared to the centrifugal stresses. The relatively hot gases also induce thermal stress due to any temperature gradient created in the turbine blade.

A turbine blade, in particular, has a useful life, i.e., total time in service after which time it is removed from service, conventionally determined based on the above-described stresses and high-cycle fatigue, low-cycle fatigue, and creep-rupture considerations. A typical turbine blade has an analytically determined life-limiting section wherein failure of the blade is most likely to occur. However, blades are typically designed to have a useful life that is well in advance of the statistically determined time of failure for providing a safety margin.

A significant factor in determining the useful life of a turbine blade is the conventionally known creep-rupture strength, which is primarily proportional to material properties, tensile stress, temperature, and time. Notwithstanding that the relatively high temperatures of the combustion gases can induce thermal stress due to gradients thereof, these temperatures when acting on a blade under centrifugal tensile stress are a significant factor in the creep consideration of the useful life. In an effort to improve the useful life of turbine blades, these blades typically include internal cooling for reducing the temperatures experienced by the blade. However, the internal cooling is primarily most effective in cooling center portions of the blade while allowing leading and trailing edges of the blade to remain at relatively high temperatures with respect to the center portions thereof. Unfortunately, the leading and trailing edges of the blade are also, typically, portions of the blade subject to the highest stresses and therefore, the life-limiting section of a blade typically occurs at either the leading or trailing edges thereof.

Furthermore, a primary factor in designing turbine blades is the aerodynamic surface contour of the blade which is typically determined independently of the mechanical strength and useful life of the blade. The aerodynamic performance of a blade is a primary factor in obtaining acceptable performance of the gas turbine engine. Accordingly, the aerodynamic surface contour that defines a turbine blade may be a significant limitation in the design of the blade from a mechanical strength and useful life consideration. With this aerodynamic performance restriction, the useful life of a blade may not be an optimum, which, therefore, results in the undesirable replacement of blades at less than optimal intervals.

Accordingly, it is an object of the present invention to provide a new and improved blade for a gas turbine engine.

Another object of the present invention is to provide an improved turbine blade effective for reducing tensile stress in a life-limiting section of the blade by adding a compressive component of bending stress thereto.

Another object of the present invention is to provide an improved turbine blade having improved useful life without substantially altering the aerodynamic surface contour of the blade.

Another object of the present invention is to provide an improved turbine blade wherein tensile stress is reduced in a life-limiting section thereof without substantially increasing stress in other sections of the blade.

SUMMARY OF THE INVENTION

The invention comprises a blade for a gas turbine engine including an airfoil portion having a non-linear stacking axis which is effective for generating a compressive component of bending stress due to centrifugal force acting on the blade. The compressive component of bending stress is provided in a life-limiting section of the blade, which, for example, includes trailing and leading edges of the blade. Inasmuch as the stacking axis, which represents the locus of centers of gravity of transverse sections of an airfoil portion of the blade, is non-linear, an increased amount of a compressive component of bending stress can be generated at a life-limiting section between root and tip sections of the blade without substantially increasing bending stress at the root of the blade.

BRIEF DESCRIPTION OF THE DRAWINGS

The invention, together with further objects and advantages thereof, is more particularly described in the following detailed description taken in conjunction with the accompanying drawings in which.

DETAILED DESCRIPTION

Figure 1:
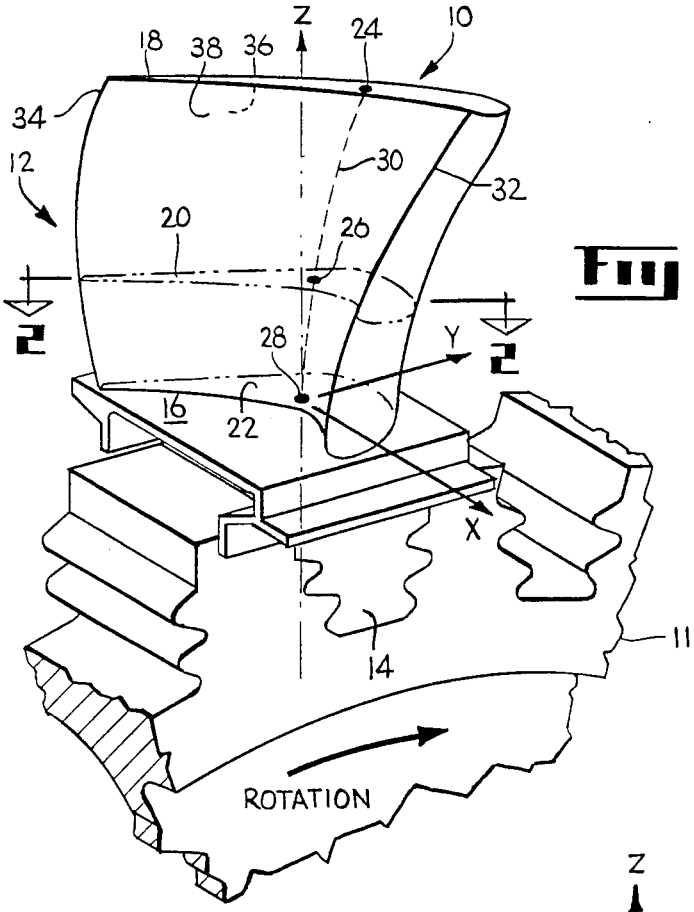
FIG. 1 is a perspective view of an axial entry blade for a gas turbine engine.

Illustrated in FIG. 1 is a generally perspective view of an exemplary axial-entry turbine blade 10 mounted in a turbine disk 11 of a gas turbine engine (not shown).

The blade 10 includes an airfoil portion 12, a dovetail portion 14 and an optional platform 16. The airfoil portion 12 of the blade 10 comprises a plurality of transverse sections including a tip section 18, an intermediate section 20 and a root section 22, each of which has a center of gravity (C.g.) 24, 26 and 28, respectively. The locus of the centers of gravity of the airfoil portion 12 define a stacking axis 30, which in accordance with the present invention is non-linear, e.g. bowed, and is described in further detail below.

The blade 10 further includes a conventional reference XYZ coordinate system having an origin at the C.g. 28 of the root section 22. This coordinate system includes: an X, axial axis, which is aligned substantially parallel to a longitudinal centerline axis of the gas turbine engine; a Y, tangential axis, which is normal to the X axis and has a positive sense in the direction of rotation of the turbine disk 11; and a Z, radial axis, which represents a longitudinal axis of the blade 10 which is aligned coaxially with a radial axis of the gas turbine engine.

Figure 2:
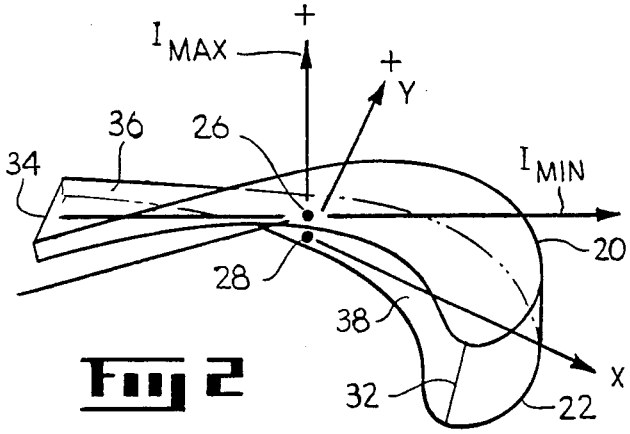
FIG. 2 is a sectional view of the blade of FIG. 1 taken along line 2—2.

As illustrated in FIGS. 1 and 2, the airfoil portion 12 of the blade 10 has an aerodynamic surface contour defined by and including a leading edge 32 and a trailing edge 34, between which extend a generally convex suction side 36 and a generally concave pressure side 38. The pressure side 38 faces generally in a negative direction with respect to the reference tangential axis Y; the suction side 36 faces generally in a positive direction with respect thereto.

Each of the plurality of transverse sections of the airfoil portion 12 of the blade 10 has its own conventionally known principal coordinate system. Illustrated in FIG. 2 is an exemplary principal coordinate system for the intermediate section 20 including an $I_{max}$ axis and an $I_{min}$ axis. The principal coordinate system has an origin at the C.g. 26 of the intermediate section 20. $I_{max}$ represents an axis of maximum moment of inertia about which the intermediate section 20 has a maximum stiffness or resistance to bending and $I_{min}$ represents an axis of minimum moment of inertia about which the intermediate section 20 has a minimum stiffness or resistance to bending.

A conventional method of designing the blade 10 includes designing the airfoil portion 12 for obtaining a preferred aerodynamic surface contour as represented by the suction side 36 and the pressure side 38. The stacking axis 30 of the airfoil portion 12 would be conventionally made linear and coaxial with the reference radial axis Z. A suitable dovetail 14 and an optional platform 16 would be added and the entire blade 10 would then be analyzed for defining a life-limiting section, which, for example, may be the intermediate section 20, which is typically located between about 40 percent to about 70 percent of the distance from the root 22 to the tip 18 of the airfoil portion 12. Of course, analyzing the blade 10 for defining a life-limiting section is relatively complex and may include centrifugal, gas and thermal loading of the blade 10, which is accomplished by conventional methods.

However, in accordance with the present invention, the method of designing the blade 10 further includes redesigning the blade having the linear stacking axis, i.e., the reference blade, for obtaining a non-linear, tilted stacking axis 30 which is effective for introducing a compressive component of bending stress in the predetermined, life-limiting section.

More specifically, it will be appreciated from an examination of FIGS. 1 and 2 that if the stacking axis 30 is spaced from the reference radial axis Z, that upon centrifugal loading of the airfoil portion 12, centrifugal force acting on the centers of gravity, C.g. 26 for example, will tend to rotate or bend the stacking axis 30 toward the reference radial axis Z thus introducing or inducing bending stress.

It will be appreciated from the teachings of this invention, that by properly tilting and spacing the stacking axis 30 with respect to the reference radial axis Z a compressive component of bending stress can be induced at both the leading edge 32 and the trailing edge 34 of the intermediate section 20 due to bending about the $I_{min}$ axis as illustrated in FIG. 2. Of course, due to equilibrium of forces, an off-setting tensile component of bending stress is simultaneously introduced in the suction side 36 of the intermediate section 20 and generally at positive values of the $I_{max}$ axis.

Figure 3:
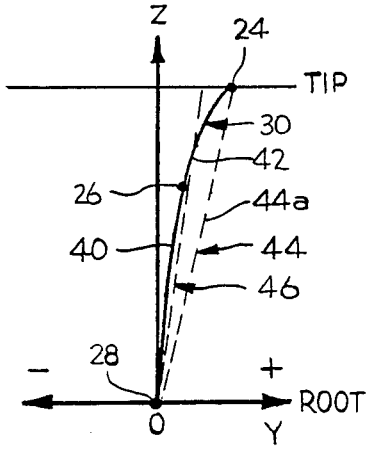
FIG. 3 is a graphical representation of the stacking axis of the blade of FIG. 1 in a Y-Z plane.

Illustrated in more particularity in FIG. 3 is an exemplary embodiment of the stacking axis 30 in accordance with the present invention and as viewed in the Y-Z plane. The stacking axis 30 extends away from and is spaced from the reference radial axis Z in a positive direction with respect to the reference tangential axis Y from, but not including, the root section 22 to the tip section 18. The stacking axis 30 is generally defined as including a first portion 40 extending from the C.g. 28 of the root section 22 to the C.g. 26 of the intermediate section 20, and a second portion 42 extending from C.g. 26 of the intermediate section 20 to the C.g. 24 of the tip section 18. Also illustrated is a reference, linear, tilted stacking axis 44 extending from C.g. 28 of the root section 22 to the C.g. 24 of the tip section 18. The stacking axis 30 has an average slope represented by dashed line 46 which, as illustrated, is larger in magnitude than the slope of the reference axis 44 and is disposed between the reference radial axis Z and the reference stacking axis 44.

Assuming, for example, that the life-limiting section of the airfoil portion 12 is located at the intermediate section 20 it will be apparent from the teachings herein that a compressive component of bending stress can be introduced in the intermediate section 20 by using either the linear stacking axis 44 or the non-linear stacking axis 30. To introduce the desired bending stress at the intermediate section 20, the stacking axis 30 must be tilted with respect to the reference radial axis Z at those sections radially outwardly from the intermediate section 20, i.e., the second portion 42 of the stacking axis 30. The slope of the stacking axis 30 is generally inversely proportional to the amount of bending stress realizable at the intermediate section 20.

As illustrated in FIG. 3, the first portion 40 has a first, average slope, and the second portion 42 has a second, average slope, the first slope being greater than the second slope. This is effective for obtaining increased bending stress at the intermediate section 20 without adversely increasing bending stress at the root section 22. Additionally, the second portion 42 of the stacking axis 30 has less of a slope than a comparable portion **44*a* of the reference linear stacking axis 44, which indicates that more bending stress can be introduced thereby at the intermediate section 20**.

However, not only is the reference linear stacking axis 44 less effective in introducing the desired bending stress to the intermediate section 20, but inasmuch as the reference stacking axis 44 is linear from C.g. 28 to the C.g. 24, substantial, undesirable bending stresses are also introduced at the root section 22. These increased bending stresses at the root 22 are a limit to the amount of bending stress introducible by the reference linear stacking axis 44 in the life-limiting section of the airfoil portion 12 in that the life-limiting section may thereby be relocated from the intermediate section 20 to the root section 22.

In contrast, inasmuch as the average slope line 46 for the non-linear stacking axis 30 has a greater magnitude than that of the reference stacking axis 44, it will be appreciated that not only does the non-linear stacking axis 30 provide for increased bending stress at the intermediate section 20 but less of a bending stress at the root 22 as compared to that provided by the reference linear stacking axis 44. Accordingly, a non-linear stacking axis 30 is more effective for introducing the desired compressive components of bending stress at the life-limiting section without adversely increasing the bending stresses at the root section 22.

FIG. 3 illustrates in more particularity the non-linear stacking axis 30 according to the present invention. The stacking axis 30 is described as being non-linear from the C.g. 28 of the root section 22 to the C.g. 24 of the tip section 18 and may include either linear or curvilinear portions therebetween.

As long as the stacking axis 30 has portions which extend away from and are spaced from the reference radial axis Z in a positive direction with respect to the reference tangential axis Y compressive components of bending stress will be introduced at the leading edge 32 and the trailing edge 34 of the airfoil portion 12.

Optimally, the magnitude of compressive stress induced is preferably made equal to approximately the compressive yield strength of the blade material. This will provide maximum compressive stress in the leading edge 32 and the trailing edge 34 during operation which will provide improved fatigue life. Furthermore, the stacking axis 30 can be tilted also to induce stresses initially greater than the compressive yield strength, which stresses will yield thereto after the first few initial cycles of operation, so that manufacturing inaccuracies do not prevent the induced stress from reaching the optimal value.

More specifically, and as additionally illustrated in FIG. 2, the tangential reference axis Y is generally aligned with the $I_{max}$ axes of the transverse sections of the airfoil portion 12, the $I_{max}$ axis of the intermediate section 20, for example. Accordingly, in operation, centrifugal forces act at each of the centers of gravity of the airfoil portion 12 and will thus tend to straighten the airfoil portion 12 to bring the stacking axis 30 closer to the reference radial axis Z. For example, when the average slope line 46 of the stacking axis 30 is spaced from reference radial axis Z in a generally positive direction with respect to the tangential axis Y and the $I_{max}$ axis, compressive components of bending stress will be introduced at the leading edge 32 and trailing 34.

Figure 4:
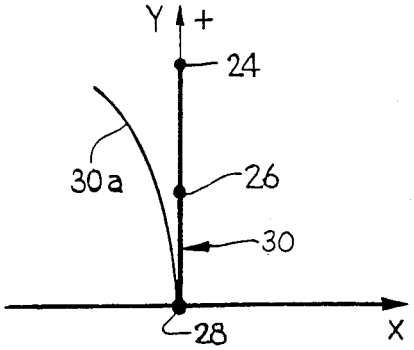
FIG. 4 is a graphical representation of the stacking axis of the blade of FIG. 1 in an X-Y plane.

Illustrated in FIG. 4 is a view of the stacking axis 30 with respect to the X-Y plane. The stacking axis 30 preferably lies substantially in a plane defined by the reference radial axis Z and tangential axis Y, is preferably linear in the X-Y plane and is preferably aligned along the positive Y axis. This is preferred so that the aerodynamic surface contour and orientation of the airfoil portion 12 does not significantly change as the stacking axis 30 is tilted.

Alternatively, the spacing of the stacking axis 30 from the reference radial axis Z could also be positive in magnitude and be substantially oriented along the $I_{max}$ direction for each of the transverse sections and might look like a stacking axis 30*a* illustrated in FIG. 4. However, the relative twist of the airfoil portion 12, i.e., its orientation with respect to the reference axial axis X, would change from that of an untilted blade, thusly changing the aerodynamic surface contour of the airfoil portion 12.

While there have been described what are considered to be preferred embodiments of the present invention, other embodiments will be apparent from the teachings herein and are intended to be covered by the attached claims.

Having thus described the invention, what is desired to be secured by Letters Patent of the United States is:

1. A blade for a gas turbine engine comprising an airfoil portion including a leading edge, a trailing edge, an intermediate section, and a non-linear stacking axis effective for introducing a compressive component of bending stress, exceeding a compressive yield strength of said blade, in said trailing edge and said leading edge of said intermediate section due to centrifugal force acting on said blade.

2. A blade according to claim 1 wherein said airfoil portion further comprises:

a plurality of transverse sections including a root section, said intermediate section, and a tip section, each having a center of gravity;

reference radial and tangential axes extending outwardly from said center of gravity of said root section; and wherein said stacking axis extends from said center of gravity of said root section and is spaced from said reference radial axis at said tip section.

3. A blade according to claim 2 wherein said stacking axis is spaced from said reference radial axis from said root section to said tip section.

4. A blade according to claim 2 wherein said airfoil portion further comprises:

a pressure side facing generally in a negative direction with respect to said reference tangential axis;

a suction side facing generally in a positive direction with respect to said reference tangential axis;

wherein said stacking axis extends away from said reference radial axis in a positive direction with respect to said reference tangential axis.

5. A blade according to claim 4 wherein said stacking axis lies substantially in a plane defined by said reference radial and tangential axes.

6. A blade according to claim 2 wherein said stacking axis further includes a first portion extending from said root section to said intermediate section and a second portion extending from said intermediate section to said tip section, said first portion having a first slope and said second portion having a second slope, said first slope being greater than said second slope.

7. A blade according to claim 2 wherein said airfoil portion further includes a predetermined life-limiting section, having an $I_{min}$ axis and an $I_{max}$ axis, and a suction side facing generally in a positive direction with respect to said $I_{max}$ axis, and wherein said stacking axis is spaced from said reference radial axis in a positive direction with respect to said $I_{max}$ axis.

8. A blade for a gas turbine engine comprising an airfoil portion including a leading edge, a trailing edge, a pressure side, and a suction side, and a plurality of transverse sections including a root section, an intermediate section, and a tip section, each of said plurality of sections having a center of gravity, the locus of which define a stacking axis, said blade further including reference radial and tangential axes extending outwardly from said center of gravity of said root section toward said tip section and said suction side, respectively, said stacking axis being non-linear and spaced from said reference radial axis from said intermediate section to said tip section and being effective for introducing a compressive component to bending stress in said trailing edge and said leading edge of said intermediate section due to centrifugal force acting on said blade, wherein said stacking axis includes a first portion extending from said root section to said intermediate section and a second portion extending from said intermediate section to said tip section, said first portion having a first slope and said second portion having a second slope, said first slope being greater than said second slope.

9. A blade for a gas turbine engine comprising an airfoil portion including a leading edge, a trailing edge, a pressure side, and a suction side, and a plurality of transverse sections including a root section, an intermediate section, and a tip section, each of said plurality of sections having a center of gravity, the locus of which define a stacking axis, said blade further including reference radial and tangential axes extending outwardly from said center of gravity of said root section toward said tip section and said suction side, respectively, said stacking axis being non-linear and spaced from said reference radial axis from said intermediate section to said tip section and being effective for introducing a compressive component of bending stress in said trailing edge and said leading edge of said intermediate section due to centrifugal force acting on said blade, wherein said stacking axis lies substantially only in a plane defined by said reference radial and tangential axes.

* * * * *